United States Patent [19]

Carbonero

[11] 3,945,068

[45] Mar. 23, 1976

[54] SWIMMER'S AID

[76] Inventor: Fred L. Carbonero, 1623 Kingsmere, Rochester, Mich. 48063

[22] Filed: Nov. 1, 1974

[21] Appl. No.: 519,870

[52] U.S. Cl. ..... 9/310 J; 272/71
[51] Int. Cl.[2] ..... A63C 15/00; A63B 69/12
[58] Field of Search ..... 9/301, 307, 310 B, 310 J; 272/71

[56] References Cited

UNITED STATES PATENTS

| | | | |
|---|---|---|---|
| 3,335,441 | 8/1967 | Wolfe | 9/307 X |
| 3,765,042 | 10/1973 | Montrella | 9/307 |

*Primary Examiner*—Trygve M. Blix
*Assistant Examiner*—Gregory W. O'Connor
*Attorney, Agent, or Firm*—Whittemore, Hulbert & Belknap

[57] ABSTRACT

The swimmer's aid is a generally S-shaped board having means on the upper surface thereof for engagement with the hands of a swimmer. The swimmer holds the board in front of him with his arms extended and propels himself by means of kicking his legs. The rearward end of the board is downturned to act as a drag. The forward end of the board is upturned to minimize any tendency of the board to dive into the water during use. The swimmer's aid is a practice device intended to assist in improving a swimmer's ability.

5 Claims, 3 Drawing Figures

SWIMMER'S AID

BACKGROUND OF THE INVENTION

Various swimmer's aids have been developed to assist swimmers in improving their swimming ability. The use of such aids is particularly helpful to swimmers engaged in competitive swimming. In competitive swimming, there are various different arm stroking and leg kicking techniques associated with different swimming strokes. Also, the posture of the swimmer in the water is of importance. When a swimmer is practicing or training, he frequently will concentrate on, for example, kicking without stroking his arms or he may concentrate on stroking his arms without kicking his arms.

The present invention is adapted to aid the swimmer in developing the kicking of his legs and also his posture in the water. The device is a platform-like structure which is engaged by the hands of the swimmer and held before the swimmer with his arms outstretched. The swimmer then propels himself in the water by means of kicking his legs.

The device is advantageous in that it is relatively unbreakable, also, it forces the swimmer to kick strongly enough so that he will not sink. The device is not buoyant as have been some prior art boards developed for generally the same purpose. The device also tends to place the swimmer is a good posture or body position in the water. The device is particularly useful for the breast-stroke and the flutterkick. It also enables a swimmer to do flip turns at the end of each length without removing the device from his hands. In a flip turn, the swimmer essentially dives into the water and turns around in the water to head in the opposite direction.

SUMMARY OF THE INVENTION

A simmer's aid is provided. The swimmer's aid is adapted to be held in a swimmer's hand and held forwardly of the swimmer in the water with the swimmer kicking his legs to propel himself. The aid comprises a board-like structure which has a central portion of a size to receive the swimmer's hands. The board-like structure includes an upturned forward portion to inhibit any tendency of the forward end of the aid to dive into the water during use of the aid and a downturned rearward portion to act as a drag in the water during use of the aid. Means are also provided on the upper surface of said central portion for engagement of the hands of a swimmer during use of the aid.

IN THE DRAWINGS

Figure 1:
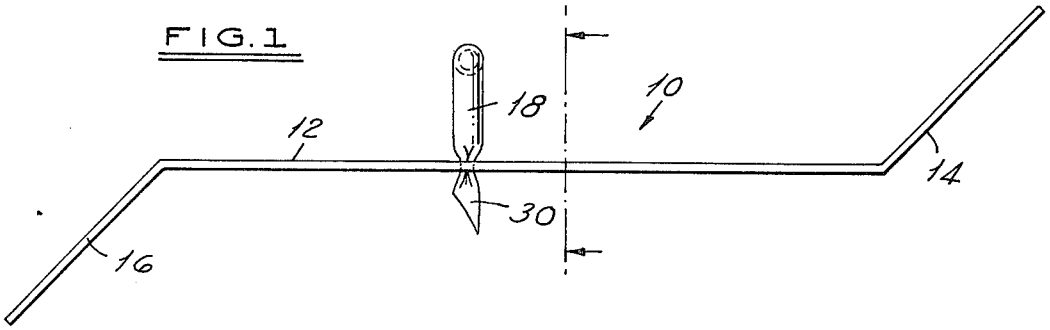
FIG. 1 is a side elevational view of one embodiment of the swimmer's aid of the present invention.
Figure 2:
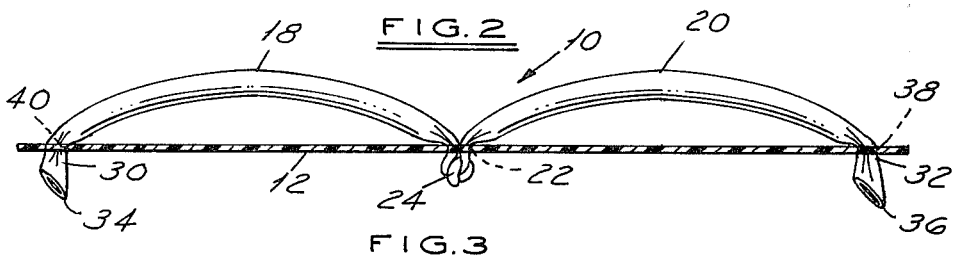
FIG. 2 is a sectional view of the swimmer's aid of FIG. 1 taken substantially along the line 2—2 looking in the direction of the arrows.
Figure 3:
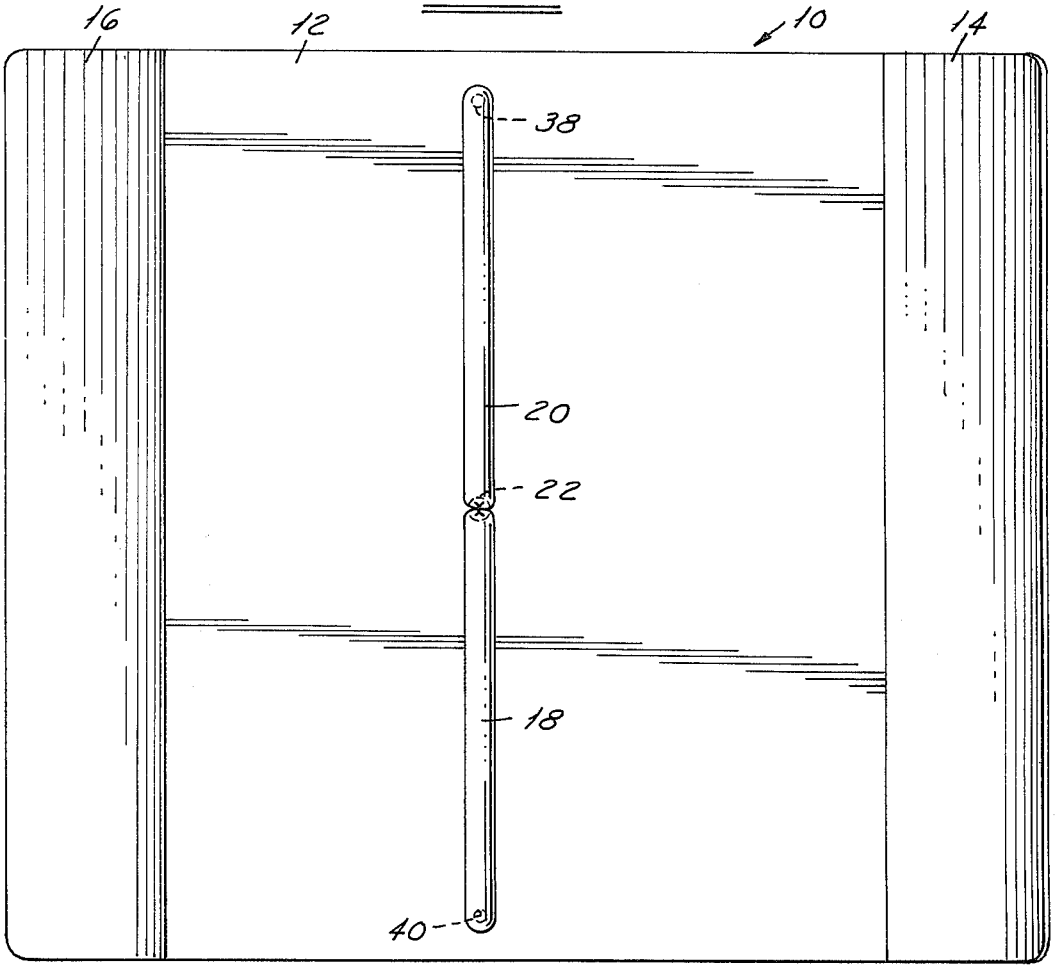
FIG. 3 is a top plan view of the swimmer's aid of FIG. 1.

Referring to the Figures, it will be noted that the swimmer's aid 10 comprises a board-like device having a general S-shape, as viewed from the side, with a central relatively large flat planer portion 12, an upturned forward end portion 14 and a downturned rearward end portion 16. The device may be fabricated of, for example, a thermoplastic high impact styrene.

Hand engageable flexible loops 18, 20 are provided generally centrally of the portion 12 but being placed somewhat closer to the rearward end than the forward end. The loops 18, 20 are formed of a single length of flexible tubing, for example, surgical rubber tubing. An opening 22 is provided in approximately the center of the portion 12. The length of the flexible tubing is knotted at the center to form a knot 24 which is too large to pass through the opening 22. In assembling the tubing onto the device 10, the ends 30, 32, are first passed through the opening 22. It will be noted that the ends 30, 32 are cut on a bias to provide a pointed end portion 34, 36 which easily first passes through the opening 22. These portions 30, 32 are then grasped and pulled whereupon the tubing will pass through the opening 22. However, when the knot 24 abuts against the underside of the board, the tubing cannot be pulled further.

Additional openings 38, 40 are provided in line with the opening 22 adjacent the side edge portions of the central portion 12. The ends 34, 36 are passed into the openings 38, 40. Again, the end portions 30, 32 are then grasped and additional portions of the tubing are pulled through the openings.

The openings 22, 38, 40 are designed to be smaller than the undeformed diameter of the tubing so that the tubing will be pinched as will be noted in FIG. 1. For example, in a typical example, tubing of ⅜ inch diameter was used. The central opening 22 was provided with a diameter of 5/16 inch while the openings 38, 40 were provided with diameter of 3/16 inch. This results in securing the tubing to the swimmer's aid 10 in such a fashion that the tubing will not come loose during normal usage of the device.

Several features of the swimmer's aid 10 may be now understood. In use of the device, the swimmer inserts the fingers of one hand through each of the loops 18, 20. His thumbs remain outside of the loops and rest over the center portion 42 where the loops meet. The swimmer's hands are easily retained in the device and are comfortably positioned on the central portion 12.

The swimmer then may use the device in the water with his arms extended forwardly. The swimmer must kick in order to propel himself in the water. Should the swimmer not kick vigorously enough, his hands will tend to sink into the water as a result of the weight of the forward portion of the swimmer's body. This tends to prevent laziness on the part of the swimmer. The upturned forward end portion 14 tends to keep the nose of the device up and prevent diving into the water. The rearward downturned end portion 16 provides a water drag which makes the swimmer kick a little bit harder and also tends to keep the device level in the water. This construction encourages the swimmer to assume a regular position or posture in the water which is advantageous in training him to swim properly.

While the swimmer's aid has been disclosed with a relatively flat central planer portion 12 and relatively flat upturned forward end portion 14 and downturned rearward end portion 16, it will be appreciated that these portions may be curved to form a more formal S-shape. Additionally, the portions 12, 14, 16 may also be provided with depressions, bulges or the like if desired.

Having thus described my invention, I claim:

1. A swimmer's aid adapted to be held in a swimmer's hands and held forwardly of the swimmer in the water with the swimmer kicking his legs to propel himself, comprising a board-like structure having a central portion of a size to receive the swimmer's hands, a forward portion which is fixedly upturned to inhibit any tendency of the forward end of the aid to dive into the water during use of the aid and a rearward portion which is fixedly downturned to act as a drag in the water during use of the aid, and means on the upper surface of said central portion for engagement of the hands of a swimmer during use of the aid.

2. A swimmer's aid as defined in claim 1, further characterized in that said board-like structure is fabricated of a substantially non-buoyant material whereby it will not buoyantly support the forward portion of the swimmer.

3. A swimmer's aid as defined in claim 1, further characterized in that said means on the upper surface of said central portion for engagement of the hands of the swimmer during use of the aid comprise a pair of side-by-side loops formed of flexible material to receive the swimmer's hands.

4. A swimmer's aid as defined in claim 3, further characterized in that said loops are positioned closer to the rearward portion of the swimmer's aid than the forward portion of the swimmer's aid.

5. A swimmer's aid as defined in claim 3, further characterized in that said loops are formed of a single length of flexible tubular material, said central portion of the boardlike structure being provided with an opening centrally thereof and an opening adjacent each side thereof, said length of flexible material having a knot formed therein adjacent the center thereof, both portions of said length of flexible material on either side of the knot extending through said central opening with said knot in abutment with the underside of said central portion, a portion of each end of the length of flexible material extending through one of said openings adjacent each side of said central portion to thereby define said loops, all of said openings being of smaller diameter than the undeformed diameter of the tubular material extending therethrough whereby the tubular material is pinched in the area of the openings to thereby retain the tubular material in place.

* * * * *